US010900354B2

(12) United States Patent
Eilouti

(10) Patent No.: US 10,900,354 B2
(45) Date of Patent: Jan. 26, 2021

(54) DRILLING AND CUTTING DEVICE

(71) Applicant: Huthaifa Eilouti, Dhahran (SA)

(72) Inventor: Huthaifa Eilouti, Dhahran (SA)

( * ) Notice: Subject to any disclaimer, the term of this patent is extended or adjusted under 35 U.S.C. 154(b) by 0 days.

(21) Appl. No.: 15/394,911

(22) Filed: Dec. 30, 2016

(65) Prior Publication Data

US 2018/0058215 A1 Mar. 1, 2018

Related U.S. Application Data

(60) Provisional application No. 62/380,489, filed on Aug. 29, 2016.

(51) Int. Cl.

| | |
|---|---|
| ***B28D 1/00*** | (2006.01) |
| ***E21C 25/34*** | (2006.01) |
| ***E21C 25/24*** | (2006.01) |
| *E21B 11/06* | (2006.01) |
| *B28D 1/08* | (2006.01) |
| *B27B 17/02* | (2006.01) |

(52) U.S. Cl.
CPC ..... *E21C 25/34* (2013.01); *E21C 25/24* (2013.01); *B27B 17/02* (2013.01); *B28D 1/082* (2013.01); *E21B 11/06* (2013.01)

(58) Field of Classification Search
CPC ..... E21C 25/34; E21C 25/28; E21C 25/30; B28D 1/082; B28D 1/124; B27B 1/02; B27B 1/025
See application file for complete search history.

(56) References Cited

U.S. PATENT DOCUMENTS

| | | | | |
|---|---|---|---|---|
| 3,593,700 | A * | 7/1971 | McNulty | |
| 3,958,332 | A * | 5/1976 | Gates | B23D 57/0007 30/380 |
| 4,079,796 | A * | 3/1978 | Staggs | |
| 4,414,876 | A * | 11/1983 | Loigerot | |
| 4,793,232 | A * | 12/1988 | Villemin | |
| 4,920,947 | A * | 5/1990 | Scott | |
| 6,178,960 | B1 * | 1/2001 | Svensson | |

FOREIGN PATENT DOCUMENTS

| | | | |
|---|---|---|---|
| GB | 468319 | A * | 1/1937 |
| WO | WO-8801559 | A1 * | 3/1988 |

* cited by examiner

*Primary Examiner* — Janine M Kreck
(74) *Attorney, Agent, or Firm* — Stonebridge IP, PLLC

(57) ABSTRACT

A drilling and cutting device for both drilling and cutting through large objects is provided. The drilling and cutting device provides a plurality of cutting elements spaced apart and connected along a cutting chain that is operatively connected to a driven gear. The cutting chain is mounted along a periphery of a guide bar adapted to force the cutting chain to move on a certain path laterally, longitudinally or rotatably when selectively engaged to a mounting assembly.

8 Claims, 4 Drawing Sheets

DRILLING AND CUTTING DEVICE

CROSS-REFERENCE TO RELATED APPLICATION

This application claims the benefit of priority of U.S. provisional application No. 62/380,489, filed Aug. 29, 2016, the contents of which are herein incorporated by reference.

BACKGROUND OF THE INVENTION

The present invention relates to drilling and cutting systems and, more particularly, to a singular device for both drilling and cutting.

Drilling wells and tunnels is very expensive because current drilling methods grind the object which consumes many expensive drill bits during this process. The alternative of using saws or cutting devices for drilling and tunneling is impractical in large objects like the ground since they require access to two or more sides of the object.

In certain drilling situations, excavation is called for where removal of earth is needed to be done carefully and systematically in order to cut samples from the ground. Unfortunately, current drill bits for drilling are inapplicable in situations calling for cutting samples from large objects as they inherently grind their cuts, breaking and damaging cuttings, and so precluding preserving desire cutting samples. And as mentioned above, sawing methods cannot sufficiently access large objects for such cuttings.

As can be seen, there is a need for a drilling and cutting device that uses much less cuts to make large holes, and so keeps them intact, preserving desired cutting samples. The present invention embodies a drilling and cutting device adapted to make shapes that cannot be done with current drilling devices as well as reach areas that current cutting devices cannot access. The present invention embodies a singular drilling and cutting device that uses a cutting chain supporting a plurality of rotatably connected cutting elements so that the drilling and cutting device may cost effectively drill holes as well as cut sideways to reach inside large objects to make holes or extract objects without destroying them. Thereby, the present invention saves the cost for large applications such as drilling wells and tunnels since it uses much less cutting elements, while keeping the cuts intact for large and small applications requiring the taking of samples, or if the cut itself is more valuable than the hole.

SUMMARY OF THE INVENTION

In one aspect of the present invention, a singular drilling and cutting device or bit includes a cutting chain; a plurality of cutting elements connected and spaced apart along the cutting chain; a driven gear having a peripheral edge engaging the cutting chain wrapped therewith around; and a guard bar providing an aperture for accommodating the driven gear, wherein a periphery of the guide bar is mounted by the cutting chain, whereby the guide bar is configured to force the cutting chain to move in latitudinal and orthogonally longitudinal directions as well as rotatably about the longitudinal direction, wherein each cutting element comprises a polyhedron solid shape having a plurality of flat polygonal faces, wherein an outer most portion of the polyhedron solid shape defines a continuous plurality of peripheral cutting edges.

In another aspect of the present invention, the singular drilling and cutting device or bit includes a cutting chain; a plurality of cutting elements connected and spaced apart along the cutting chain, wherein each cutting element comprises a polyhedron solid shape having a plurality of flat polygonal faces defining a plurality of peripheral cutting edge, each cutting edge defined by a convergence of two flat polygonal faces so that each cutting edge extends beyond a periphery of the cutting chain; a driven gear having a plurality of gear teeth radially protruding from an edge thereof so as to engage and drive the cutting chain; a guard bar providing an aperture for accommodating the driven gear, wherein a periphery of the guide bar is mounted by the cutting chain; and a drive motor operatively connected to the driven gear, wherein the drive motor is accommodated by the aperture.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a drilling and cutting device for both drilling and cutting through large objects, such as rock formations. The drilling and cutting device provides a plurality of cutting elements spaced apart and connected along a cutting chain that is operatively connected to a driven gear. The cutting chain is mounted along a periphery of a guide bar adapted to force the cutting chain to move on a certain path laterally, longitudinally or rotatably when selectively engaged to a mounting assembly. The drilling and cutting device coupled with the movement of the mounting assembly enables both drilling and cutting of objects without having to switch devices within certain applications. These applications may range from drill rig utilization to handheld carving devices.

Figure 1:
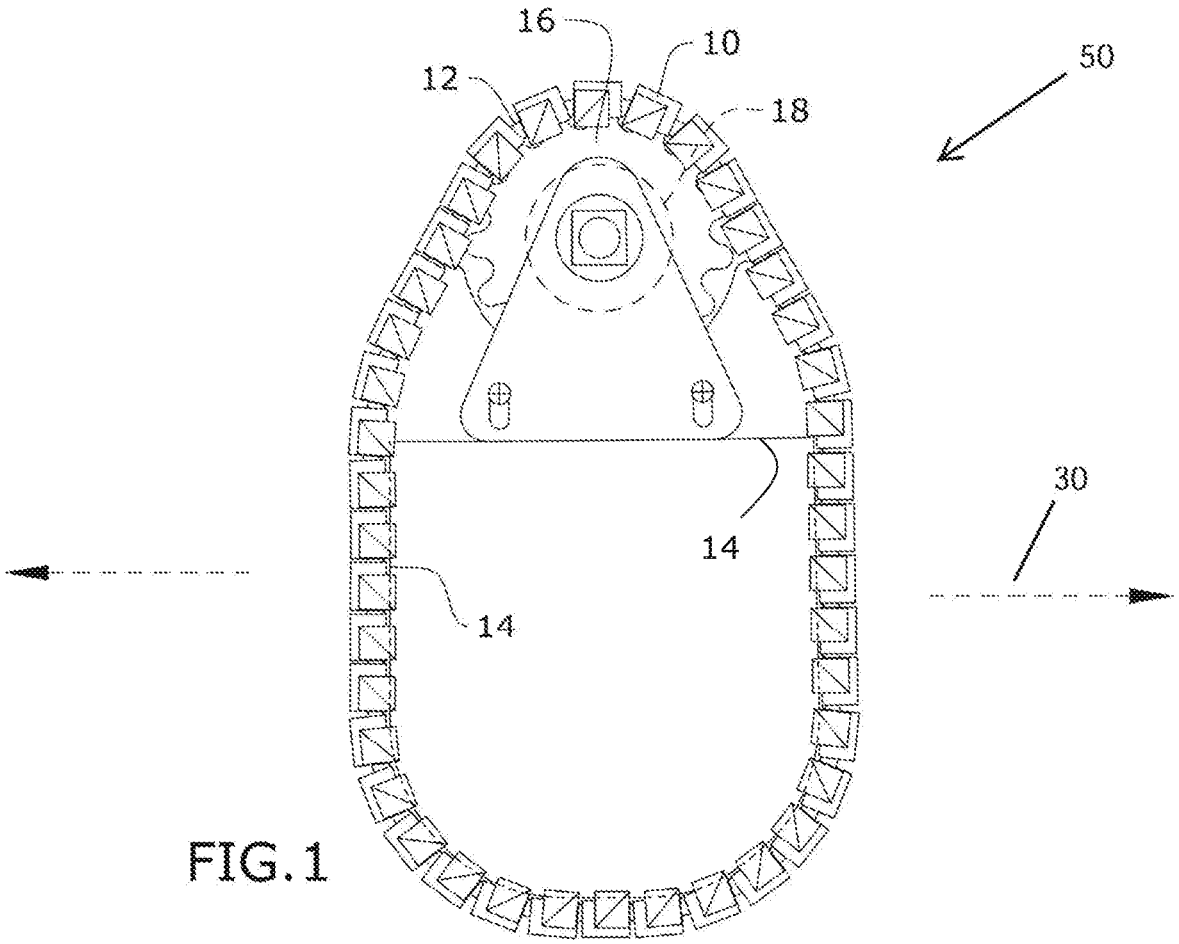
FIG. 1 is a front view of an exemplary embodiment of the present invention, demonstrating lateral/latitudinal movement.
Figure 2:
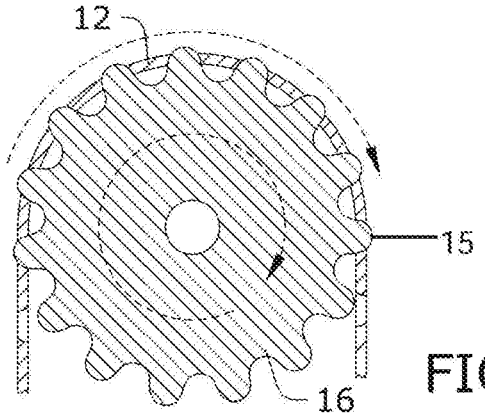
FIG. 2 is a section view of an exemplary embodiment of the present invention.
Figure 3:
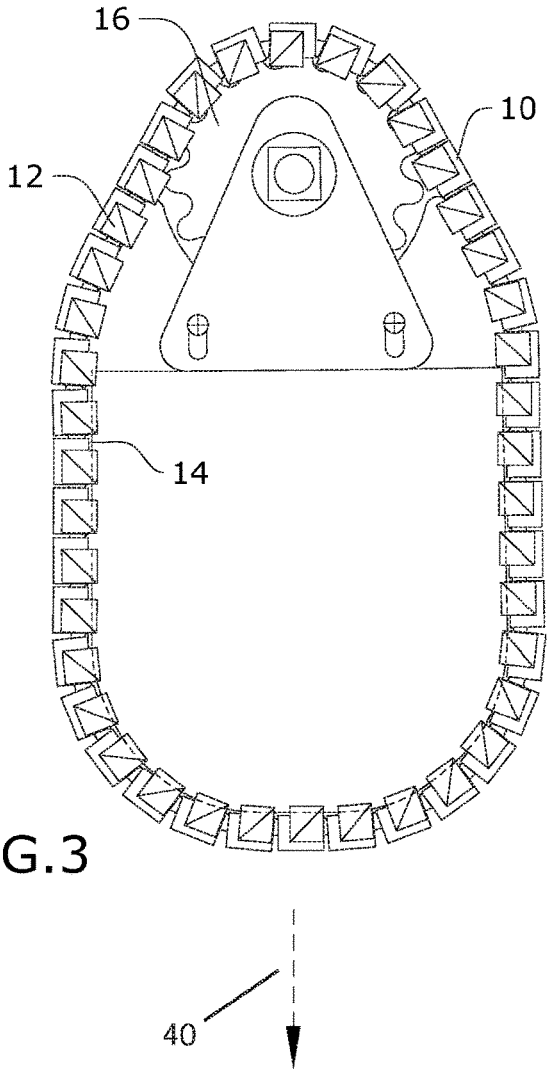
FIG. 3 is a front view of an exemplary embodiment of the present invention, demonstrating vertical/longitudinal movement.
Figure 4:
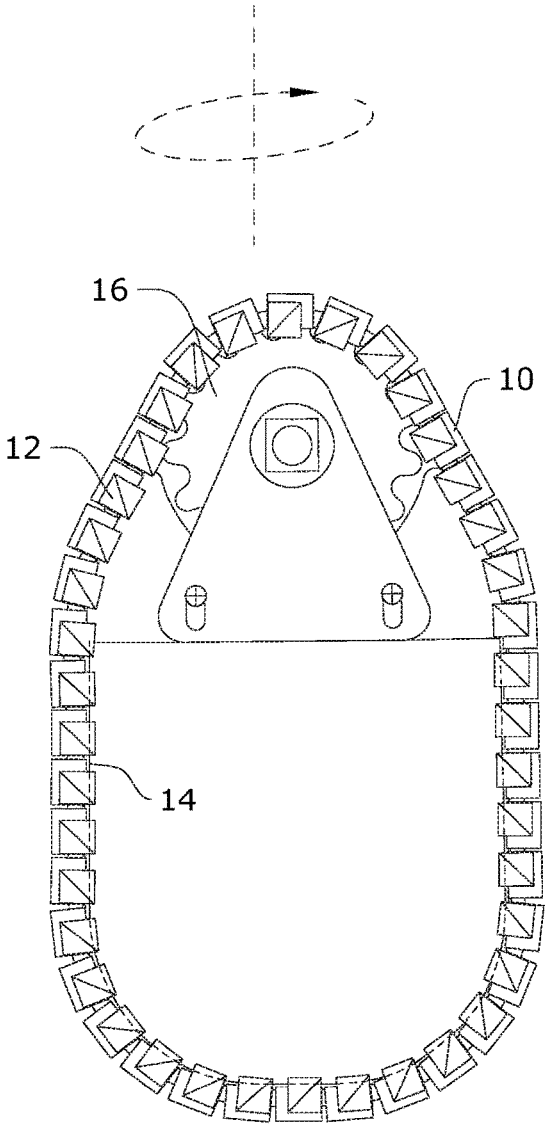
FIG. 4 is a front view of an exemplary embodiment of the present invention, demonstrating rotation along a vertical/longitudinal axis.

Referring to FIGS. 1 through 4, the present invention may include a drilling and cutting device 50 utilizing a plurality of cutting elements 10, each cutting element 10 dimensioned and adapted to cut from one side, both sides or three sides with an opening on its back side. The plurality of cutting elements 10 may be connected to and spaced apart along a cutting chain 12. The drilling and cutting device 50 may include a driven gear 16 having a plurality of gear teeth 15 radially protruding from an edge thereof so as to engage and drive the cutting chain 12 wrapped therewith around. The driven gear 16 is operatively connected to a drive motor 18 which selectively provides various torques to the driven gear 16. A guide bar 14 is provided, wherein the guide bar 14 provides a first aperture for the driven gear 16 and drive motor 18, as illustrated in FIGS. 1, 3 and 4. A periphery of the guide bar 14 may be mounted by the cutting chain 12 so that the guide bar 14 may be dimensioned and adapted to force the cutting chain 12 to move on a certain path. The guide bar 14 may be planar.

Figure 5:
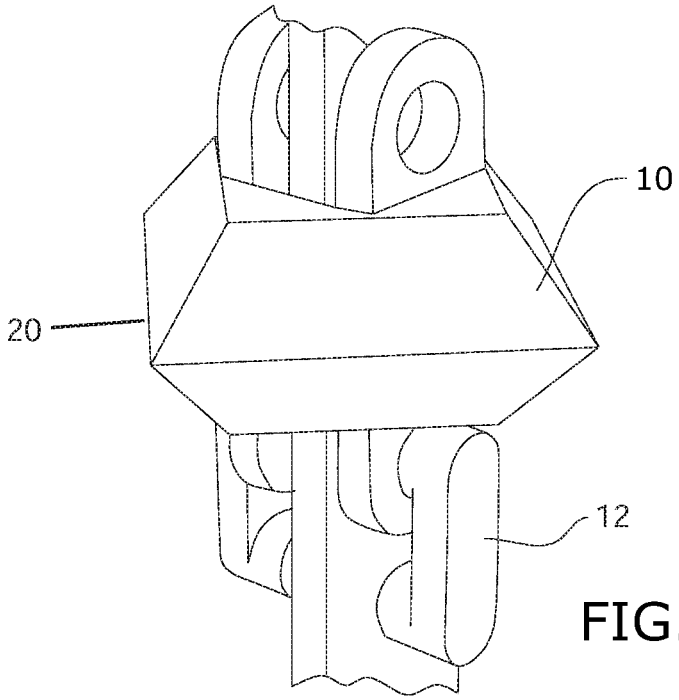
FIG. 5 is a perspective detail view of an exemplary embodiment of a cutting element 10 of the present invention.
Figure 6:
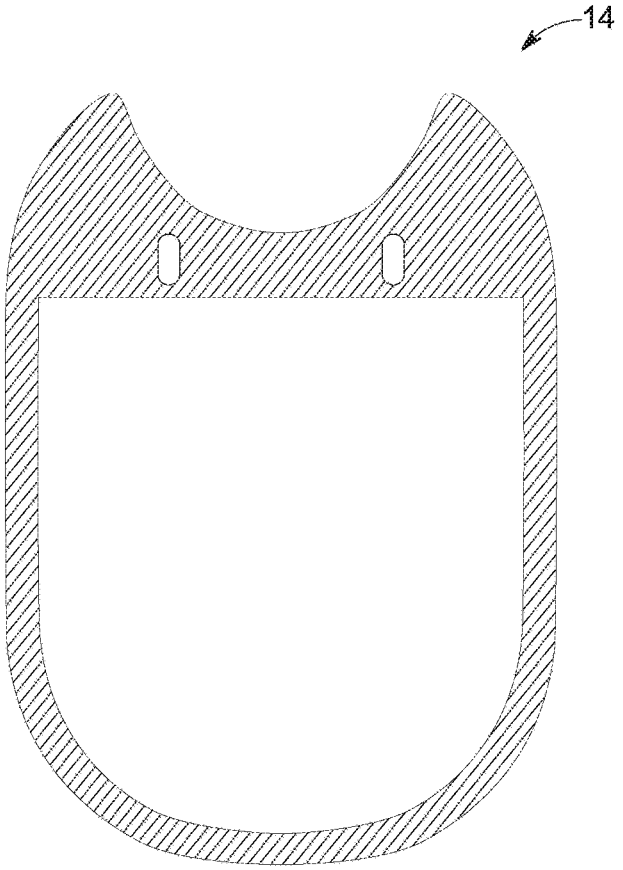
FIG. 6 shows a guide bar of the disclosure.

Referring to FIG. 5, the cutting element 10 may be a polyhedron solid in three dimensions with flat polygonal faces, straight edges and sharp corners or vertices. Each cutting element 10 may provide a plurality of cutting edges 20 along a four-sided plane, wherein the cutting edges extend the furthest from a center of the cutting element and extend past a periphery of the cutting chain. In certain embodiments, the cutting element 10 forms the shape of a to-go sandwich container.

The present invention may include a mounting assembly (not shown) that controls the movement and path of the drilling and cutting device 50. The mounting assembly may be selectively connected to the directional motor (not shown), which provides directional movement along a latitudinal axis 30 and an orthogonal longitudinal axis 40 to the drilling and cutting device 50, and which rotates and selectively provides various torques to the drilling and cutting device 50 about at least the longitudinal axis 40.

A method of using the present invention may include the following. The drilling and cutting device 50 disclosed above may be provided. A user may mount the drilling and cutting device 50 on the mounting assembly that controls the movement and rotation of the drilling and cutting device 50. Then the user may begin by starting the drive motor 18. Pointing the cutting chain 12 to the desired object, adjust the speed to make appropriate cuts, and then push the drilling and cutting device 50 slowly to the direction required. The direction can be, for example, forward laterally along the latitudinal axis 30 to penetrate the object, then move sideways or vertically along the longitudinal axis 40 to further make/define the desired shape, and then rotate the drilling and cutting device 50 about the longitudinal axis 40 to facilitate cutting out the desired shape from the object.

Having cutting elements 10 along both sides of the guide bar 14, and having the capability to move the drilling and cutting device 50 laterally, longitudinally and rotatably enables the present invention to make other regular cuts without having to switch devices within certain applications, wherein the movement of the mounting assembly controls the overall, final shape. Adjusting the shape and strength of the guide bar 14 may give more options for cutting desired shapes.

The size of the drilling and cutting device 50 depends on the application that can be for oil wells, tunnels, or even pineapple coring. For smaller applications, drilling and cutting device 50 can be embodied in handheld devices for specific applications enable better and faster cuts with less cost. In larger applications, such as those involving drilling rigs allowing for contoured trajectories, vertical sections, horizontal sections, and deviated sections for example, the use of the present invention reduces the cost of drilling wells, while enabling the drilling rigs to extract objects without damaging them; such as cutting rocks from mountains and use them for buildings and construction. In short, the present invention can be used as add on to existing drills, chainsaws, and corers.

It should be understood, of course, that the foregoing relates to exemplary embodiments of the invention and that modifications may be made without departing from the spirit and scope of the invention as set forth in the following claims.

What is claimed are:

1. A device, comprising:

a cutting chain;

a plurality of cutting elements connected and spaced apart along the cutting chain wherein each cutting element is dimensioned and adapted to cut from one side, both sides, or three sides;

a driven gear having a peripheral edge engaging the cutting chain wrapped therewith around; and a guide bar providing an aperture for accommodating the driven gear, wherein a periphery of the guide bar is mounted by the cutting chain;

whereby the guide bar is configured to force the cutting chain to in latitudinal and orthogonally longitudinal directions as well as rotatably about the longitudinal direction.

2. The device of claim 1, further comprising a drive motor operatively connected to the driven gear.

3. The device of claim 2, wherein the drive motor is accommodated by the aperture.

4. The device of claim 1, wherein each cutting element comprises a polyhedron solid shape having a plurality of flat polygonal faces, wherein an outer most portion of the polyhedron solid shape defines a continuous plurality of peripheral cutting edges.

5. The device of claim 4, wherein each cutting edge is defined by a convergence of two flat polygonal faces.

6. The device of claim 4, wherein each cutting edge extends beyond a periphery of the cutting chain.

7. The device of claim 1, wherein the driven gear has a plurality of gear teeth radially protruding from an edge thereof so as to engage and drive the cutting chain.

8. The device of claim 1, wherein each cutting element comprises three peripheral cutting edges:

a first edge of the three peripheral cutting edges spaced apart from an outward-facing periphery of the cutting chain; and a second edge and an opposing third edge of the three peripheral cutting edges, each orthogonal to the first of the three peripheral cutting edges.

* * * * *